US010325690B2

(12) United States Patent
Hilbert et al.

(10) Patent No.: US 10,325,690 B2
(45) Date of Patent: Jun. 18, 2019

(54) TRANSPORT ARRANGEMENT

(71) Applicant: DAHER NUCLEAR TECHNOLOGIES GMBH, Hanau (DE)

(72) Inventors: Franz Hilbert, Wiesbaden (DE); Tim Cloppenborg, Langen (DE)

( * ) Notice: Subject to any disclaimer, the term of this patent is extended or adjusted under 35 U.S.C. 154(b) by 0 days.

(21) Appl. No.: 16/066,725

(22) PCT Filed: Jan. 4, 2017

(86) PCT No.: PCT/EP2017/050127
§ 371 (c)(1),
(2) Date: Jun. 28, 2018

(87) PCT Pub. No.: WO2017/118652
PCT Pub. Date: Jul. 13, 2017

(65) Prior Publication Data

US 2018/0366236 A1 Dec. 20, 2018

(30) Foreign Application Priority Data

Jan. 7, 2016 (DE) ..... 10 2016 000 071

(51) Int. Cl.
*G21F 5/12* (2006.01)
*G21F 5/08* (2006.01)
*B65D 1/16* (2006.01)

(52) U.S. Cl.
CPC ..... *G21F 5/12* (2013.01); *B65D 1/16* (2013.01); *G21F 5/08* (2013.01)

(58) Field of Classification Search
CPC ..... G21F 5/12; G21F 5/08; B65D 1/16
(Continued)

(56) References Cited

U.S. PATENT DOCUMENTS 5,799,685 A * 9/1998 Tezuka ..... G21F 5/08 137/375
2011/0168600 A1 7/2011 Hilbert et al.
2014/0001381 A1 1/2014 Dougherty

FOREIGN PATENT DOCUMENTS

JP 2004069620 A 3/2004
JP 2004170177 A 6/2004
JP 2004170177 A * 6/2004

OTHER PUBLICATIONS

International Search Report, dated Mar. 23, 2017, corresponding to Application No. PCT/EP2017/050127.
(Continued)

*Primary Examiner* — Michael Maskell
(74) *Attorney, Agent, or Firm* — Ladas & Parry LLP; Malcolm J. MacDonald

(57) ABSTRACT

A transport arrangement having an inner container, preferably having at least one apron projecting beyond an end face of the inner container, an outer container, which receives the inner container, and a twist prevention device, by means of which the containers can be locked together to prevent them from twisting about their longitudinal axes. The twist prevention device has a locking element that is axially adjustable in a first receptacle, a second receptacle that rotatably receives the first receptacle and is fixedly connected to one of the containers, and a handle that extends from the first receptacle and is radially guided by the second receptacle, the pivoting movement of said handle being convertible via the first receptacle into the axial adjustment of the locking element for engagement in the other container or disengagement therefrom.

8 Claims, 9 Drawing Sheets

Figure 1:
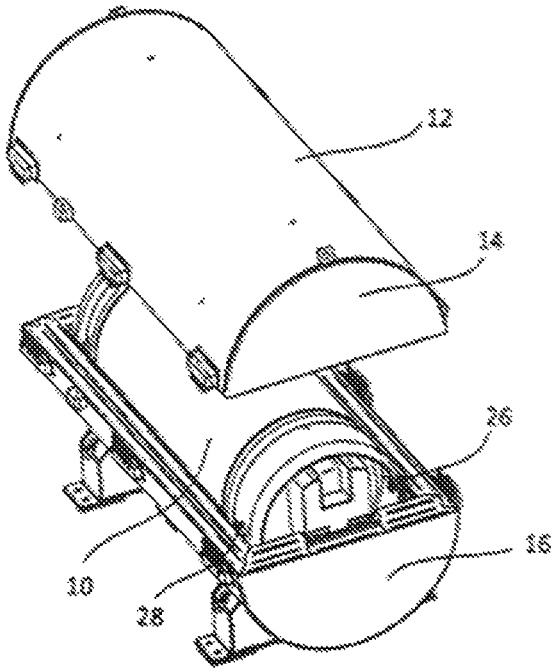

(58) Field of Classification Search
USPC ..... 250/505.1, 506.1, 507.1
See application file for complete search history.

(56) References Cited

OTHER PUBLICATIONS

International Standard, ISO 7195, "Nuclear energy—Packaging of uranium hexafluoride (UF6) for transport", Second edition Jan. 9, 2005 (2005).
American National Standard, ANSI N14.1-2012, "Uranium Hexafluoride—Packagings for Transport" (2012).
IAEA Safety Standards, Specific Safety Requirements No. SSR-6, "Regulations for the Safe Transport of Radioactive Material" 2012 Edition (2012).

* cited by examiner

C - C

TRANSPORT ARRANGEMENT

The invention relates to a transport arrangement, particularly for transporting uranium hexafluoride, comprising an inner container, preferably having at least one apron projecting beyond an end face of the inner container, an outer container, which receives the inner container, and a twist prevention device, by means of which the containers can be locked together to prevent them from twisting about their longitudinal axes.

Transport arrangements, particularly for transporting uranium hexafluoride, with an inner container and an outer container surrounding it can be found in WO 2013/134384 A1 or EP 2 335 251 B1, for example.

A generic arrangement can be found in EP 0 777 238 A1. To avoid the twisting of the inner container in relation to the outer container, the transport arrangement includes a twist prevention device in the form of a ribbon-shaped element, which is embedded into the interior wall of the outer container and which is in the shape of a semi-circle. The ends of the twist prevention device are connected to the apron of the inner container.

In general terms, the invention relates to a twist prevention device for containers relative to each other, in order to prevent the rotation of the containers, specifically both under normal transport conditions and under accident-related transport conditions. Such a rotation about the longitudinal axes of the containers in relation to each other particularly could occur when the inner container is only partially filled in terms of volume. This can result in a rotational momentum, especially if an impact occurs in such a manner that the center of gravity of the inner container is not located vertically above the point of impact.

Specifically, the invention relates to a twist prevention device for containers for the transport of uranium hexafluoride, which prevents a rotation of the inner container loaded with $UF_6$, such as a 30B cylinder, relative to the outer protective packaging under the assumed normal transport conditions and accident-related transport conditions. The $UF_6$ in the inner container under transport conditions (solid state) is predominantly located in the lower half of the container, which is only filled to about 60% in terms of volume. Side impacts therefore may result in a rotational momentum, as the center of gravity of the inner container is not vertically above the point of impact.

Uranium hexafluoride typically is transported in cylinder-shaped steel containers. These containers are specified in ISO 7195 "Packaging of Uranium Hexafluoride ($UF_6$) for Transport," and/or in ANSI N14.1 "Uranium Hexafluoride—Packaging for Transport." During transport, these containers must fulfill the requirements of SSR-6 "Regulations for the Safe Transport of Radioactive Material" of the IAEA, as well as the requirements of international and national regulations derived from the latter. Steel containers for uranium hexafluoride with an enrichment of more than 1 weight percent uranium-235 in the uranium are surrounded by a protective container during transport, which is meant to provide compliance with the aforementioned regulations. Steel container, protective container and the contents of uranium hexafluoride form the package in the sense of the regulations.

In containers, which hold uranium hexafluoride with an enrichment of more than 1 weight percent, but no more than 5 weight percent, of uranium-235 in the uranium, neither the valve nor the plug may come in contact with any other component of the protective packaging or the inner container—aside from the original point of attachment—during the tests described in the following under items 1 to 3.

The following tests must be conducted on one and the same package:

1. A drop test from a height depending on the weight of the package (for example, 1.2 m for a weight of the package of up to 5,000 kg) onto an unyielding target.
2. A drop from 9 m height onto an unyielding target.
3. A drop from 1 m height onto a steel cylinder with a diameter of 150 mm and a minimum length of 200 mm.

To protect the valve, it is known that a valve protector is integrated into the protective packaging, such as can be found in EP 2 335 251 B1. However, this only provides effective protection to the extent that the valve remains in the 12-o'clock position during and after the aforementioned test conditions. The valve could hit the valve protector if the inner container rotates.

Across from the valve, a plug is arranged in the 6-o'clock position. A metal pan is welded onto the corresponding place in the protective packaging, which creates sufficient room for relative movement of plug and protective packaging to avoid any contact between plug and protective packaging. However, this safety characteristic only is effective if the plug remains in the 6-o'clock position. If the inner container were to rotate, no sufficient room would be available for relative movements between plug and protective container to protect the plug from coming into contact with the protective container.

Currently used protective packages for inner containers for transporting $UF_6$ are the designs UX-30, MST-30 and COG-OP-30B. Of these, only the design MST-30 comprises twist prevention (approval number J/159/AF-96 (Ver. 2)).

The twist prevention of the design MST-30 consists of a bent flat bar, which on one side is attached to the flange of the lower shell of the protective package via a hinge and which comprises a welded-on pin on the other side, which engages with one of the two boreholes in the apron of the 30B cylinder. As the boreholes are arranged at the 3-o'clock and 9-o'clock positions in the apron of the 30B cylinder, the cylinder must be turned 30° to be able to insert the pin into the borehole. As the cylinder is always stored and handled with its valve in the 12-o'clock position, this turning of the cylinder (which has a weight of 3,000 kg when loaded) is associated with great effort and potential hazards for the operators.

The object underlying the present invention is to further develop an arrangement of the type described above in such a manner that it provides twist prevention in a simple design. According to an additional aspect of the invention, it will provide the option of determining whether the twist prevention is in its effective position without elaborate monitoring measures.

The twist prevention device according to the invention is intended to prevent rotational movements of the inner container potentially resulting from the mechanical stress under transport and accident-related conditions. It is intended to facilitate the secure and economical operation while requiring little maintenance. It should be operable by a single person without tools.

One or more of the aforementioned aspects are achieved in the invention by the arrangement of the type described above, wherein the twist prevention device comprises:

a locking element that is axially adjustable in a first receptacle and in that receptacle's longitudinal direction, a second receptacle that rotatably receives the first receptacle and is fixedly connected to one of the containers, and a handle that extends from the first receptacle and is radially guided by the second receptacle transversely or perpendicular to the second receptacle's longitudinal axis, the pivoting movement of said handle being convertible via the first receptacle into the axial adjustment of the locking element for engagement in the other container or disengagement therefrom.

In particular, the design is such that the twist prevention device extends from the outer container, which preferably consists of two shells joined together in one plane.

Preferably, the invention comprises a first receptacle that includes a hollow cylinder shape with at least one helical opening in axial direction, that is, in its longitudinal direction, wherein said opening is penetrated by at least one protrusion extending from the locking element, wherein the protrusion engages with a recess extending in the longitudinal direction of the second receptacle. This guarantees that the locking element, which preferably is designed as a stud, can be moved axially during a rotational movement of the first receptacle, and that the locking element thereby sufficiently engages with—or, respectively, can be removed from—the other container, in particular the inner container, preferably with/from its apron.

In the further development of the invention, it is provided that the second receptacle comprises a second opening extending radially, which is penetrated by the handle extending from the first receptacle. The second opening is located in a plane extending perpendicularly to the longitudinal axis of the second receptacle and preferably extends over an arc length $\pi$.

The handle can easily be swiveled, wherein the resulting synchronous movement of the first receptacle (as a sleeve), the penetration of the at least one helical opening in the first receptacle by the stud extending from the locking element (as a locating pin), and the stud's engaging with the longitudinal opening (as a groove) cause the locking element in the second receptacle to axially adjust itself to the first and second receptacle. The swiveling movement of the handle and the corresponding axial adjustment of the locking element can be performed by a single person without additional tools.

In particular, the design provides two helical first openings in the longitudinal direction of the first receptacle, wherein protrusions extending from the locking element engage with each of the first openings like an adjusting pin.

In a noteworthy further development of the invention, an arrangement of the type described above—in which the outer container, that is, the protective packaging, consists of two shells that are joined when properly surrounding the inner container—is designed such that the handle can be positioned in a locking position and in an unlocking position, wherein the shells are joined in the locking position of the handle, such that the outer container properly surrounds the inner container, and wherein the shells are positioned at a distance from each other in the area of the handle when the same is in the unlocking position. This last scenario means that the outer container—that is, the shells—cannot be properly closed and the transport unit therefore cannot be used.

To implement such a safety measure, the invention in particular provides two support elements for the handle, which extend from one of the shells, wherein the handle can brace against—or, respectively, rest upon—one of these support elements in the handle's unlocking or locking position, and a counter element associated with one of the support elements, said counter element extending from the respective other shell, wherein the distance between the counter element and the associated support element is smaller than the effective extent of the handle between these two elements when the outer container is properly enclosing the inner container.

This way, it is ensured that it is impossible to close the outer container when the handle rests upon the support element in which the locking element is engaged with the inner container, because the necessary distance between support element and counter element, which facilitates the proper closure of the outer container, cannot be achieved due to the handle being positioned between these two elements; this is the case because, as mentioned previously, the gap between the support element and the counter element is smaller than the effective extent of the handle between these two elements during proper closure.

However, if the handle braces against the support element, which is not associated with the counter element, it is possible to close the outer container. Thereby, it can be ensured in simple fashion that the outer container can only be closed when the outer container is locked to the inner container, that is, when the proper twist prevention is guaranteed.

Additional details, advantages and characteristics of the invention follow not only from the claims and the characteristics contained in the same—on their own and/or in combination—but also from the preferable exemplary embodiments described in the following and in the drawings.

These show:

FIG. 1 A container

Figure 2:
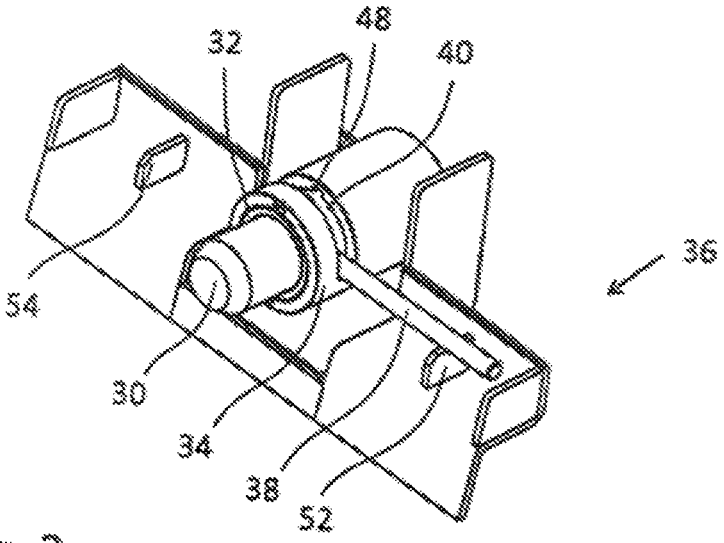

FIG. 2 A perspective diagram of a twist prevention device

Figure 3:
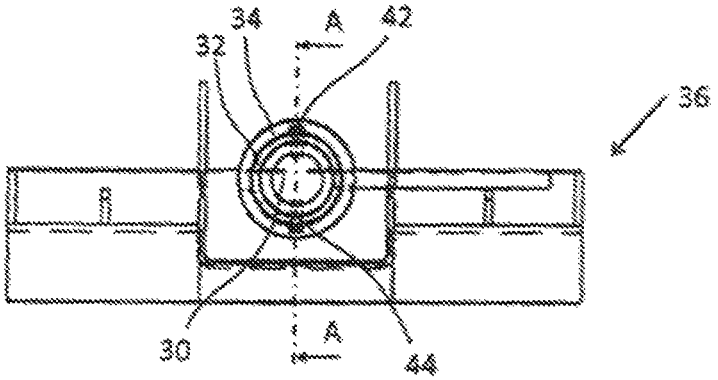

FIG. 3 A front view of the twist prevention device according to FIG. 2

Figure 4:
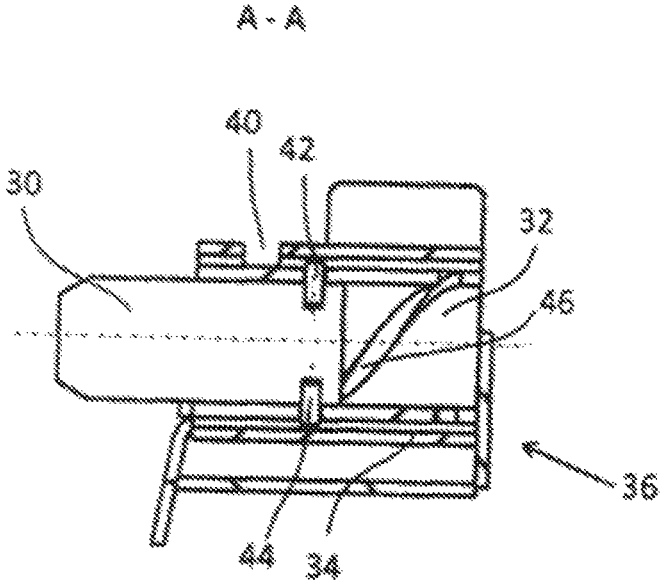

FIG. 4 A sectional view along the line A-A in FIG. 3

Figure 5:
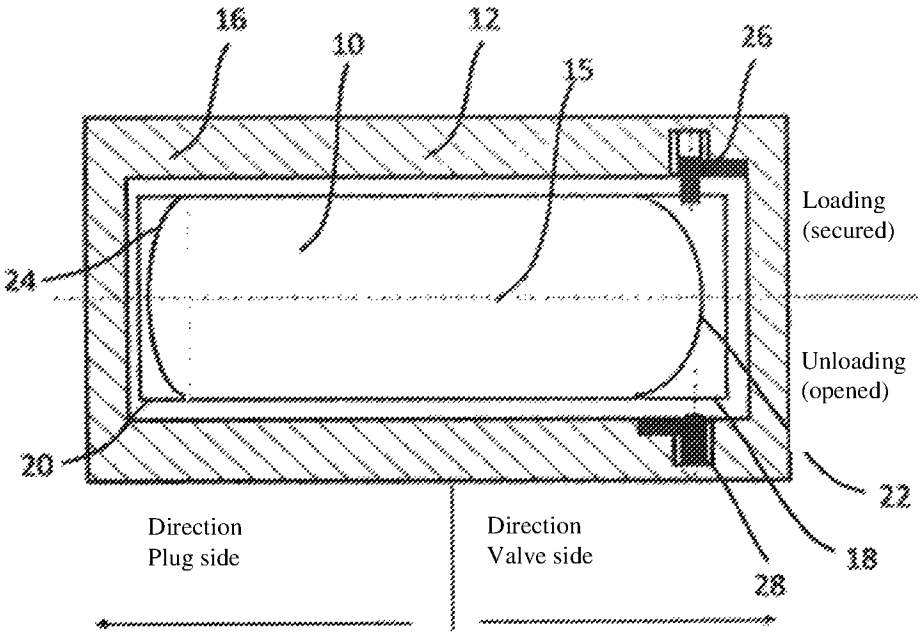

FIG. 5 A schematic diagram of a container in horizontal view

Figure 6:
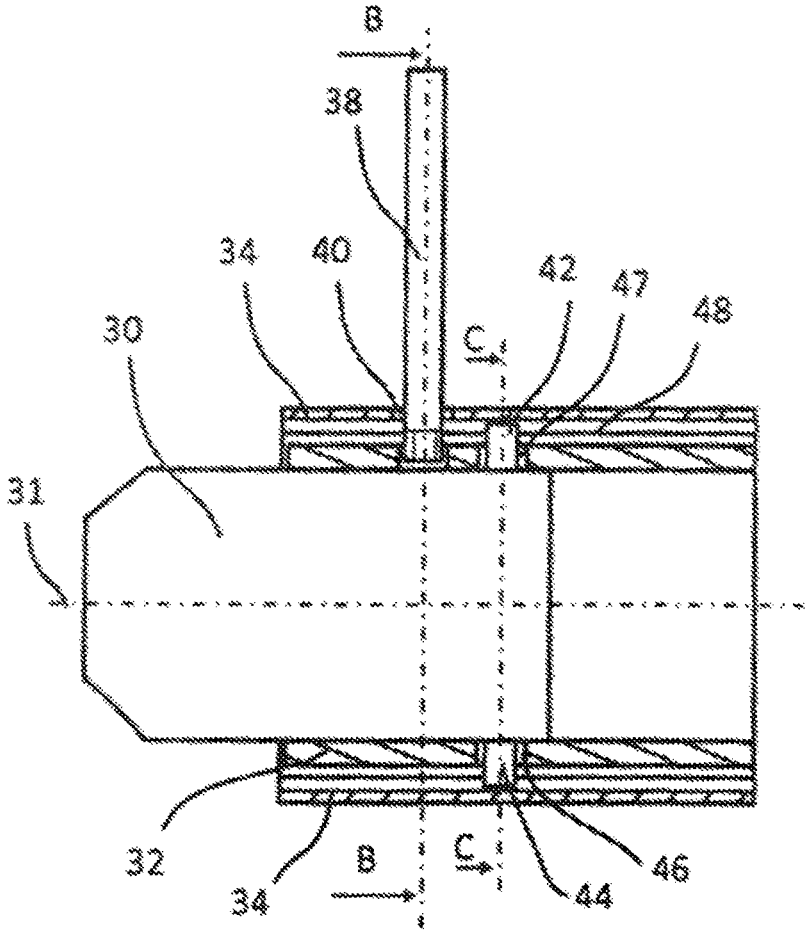

FIG. 6 A longitudinal view through the twist prevention device according to FIG. 2

Figure 7:
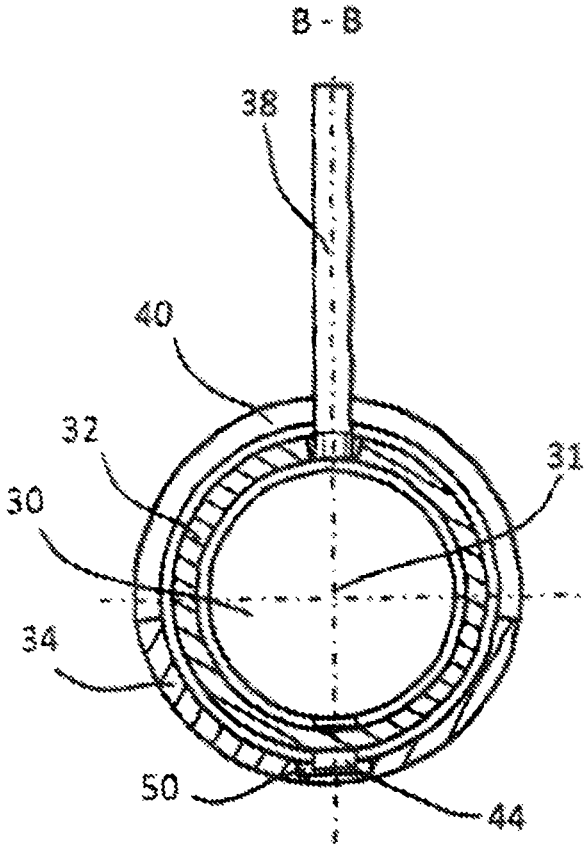

FIG. 7 A sectional view along the line B-B in FIG. 6

Figure 8:
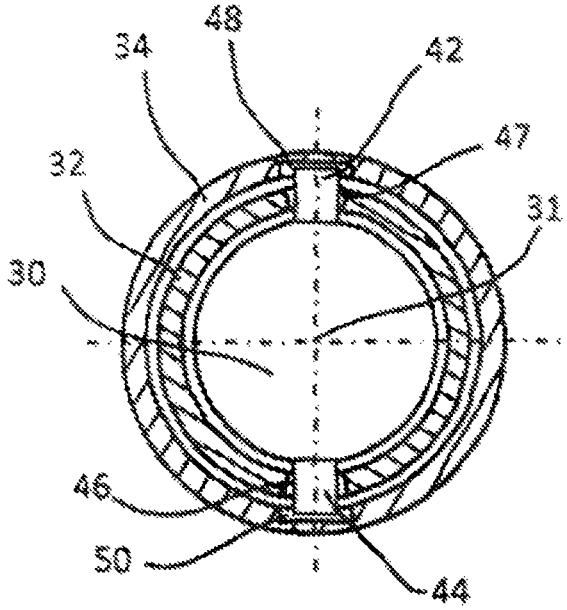

FIG. 8 A sectional view along the line C-C in FIG. 6

Figure 9:
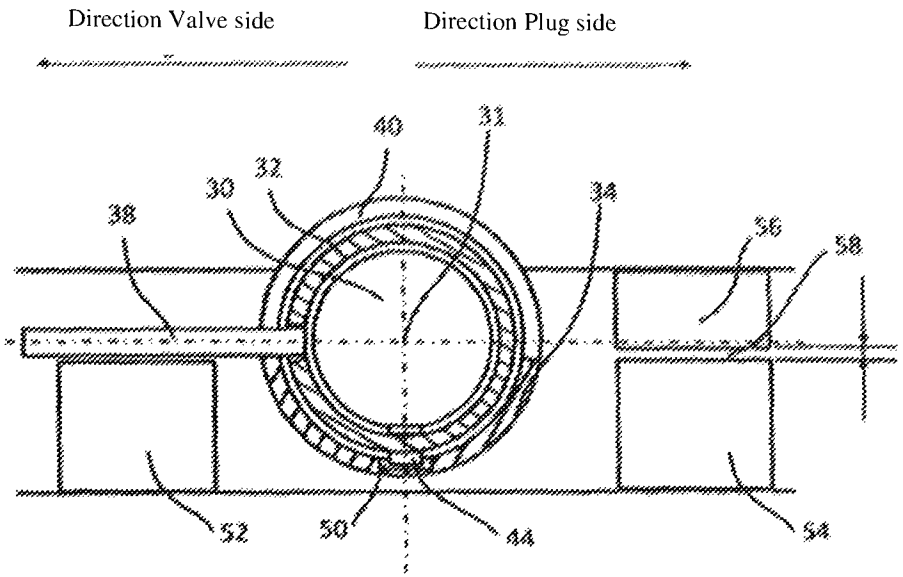

FIG. 9 The twist prevention device according to FIGS. 6 to 8 in the position locking the inner and outer containers of the container The drawings show schematic diagrams of a transport arrangement with a twist prevention device, which safeguards an inner container 10 and a protective packaging to be described as outer container 12 with regards to twisting, such that the inner container 10 is prevented from twisting or rotating relative to the outer container 12, thus precluding damages to components of the inner container 10 such as a valve or plug. In this context, the twist prevention device works both under normal transport conditions and under accident-related conditions, such that even an impact of the outer container 12 outside of the 6-o'clock position would not lead to a rotation.

FIGS. 1 and 5 show schematic diagrams of the inner container 10 receiving or containing specifically uranium hexafluoride and of the outer container 12, which consists of two shells 14, 16, which, in the assembled state of the outer container 12, specifically are joined in a plane that extends horizontally.

As can be seen in the horizontal sectional view in FIG. 5, the inner container 10 comprises aprons 18, 20, which protrude from the front sides 22, 24 of the inner container 10. In the exemplary embodiment, two twist prevention devices 26, 28, which extend from the lower shell 16, engage with the apron 18 shown on the right in FIG. 5 when the device is in transport position, in order to preclude a rotation of the unit comprising the inner container 10 and the outer container 12 about their longitudinal axis 15 relative to each other.

The diagrams show that the twist prevention device 26, 28 includes a locking element, which in the exemplary embodiment is designed as stud 30, which is axially moveable in an inner sleeve 32 comprising a hollow cylinder shape. The sleeve 32 can be described as a first receptacle, which is rotatably received by a second receptacle 34, which in turn is fixedly connected with the lower shell 16 of the outer container 12. The second receptacle 34, which also comprises a hollow cylinder geometry in the exemplary embodiment, extends from a bracket 36, which is connected with the lower shell 16.

A handle 38 extends from the first receptacle 32, said handle having a bar shape, although the inventive teaching is not limited to this embodiment. The handle 38, which is referred to as a grip in the following, penetrates a radially extending opening 40 in the second receptacle 34 or sleeve, which may comprise an arc length of 7E. The opening 40 therefore extends in a plane, which transversely or perpendicularly crosses the longitudinal axis 31 of the twist prevention device 26, 28 and thereby the longitudinal axis both of the inner sleeve 32 and of the outer sleeve 34.

As illustrated in the cross-sectional view of FIG. 8, protrusions such as the locating pins 42, 44 extend from the stud 30, which protrude diametrically opposite from the outer surface of the stud 30. The locating pins 42, 44 penetrate helical openings 46, 47 extending in the axial direction of the first receptacle or inner sleeve 32, in order to engage with recesses extending in the axial direction of the second receptacle or sleeve 34, such as grooves 48, 50.

Due to the helical openings 46, 47 in the first receptacle 32 and the penetration of these openings by the radially protruding protrusions or locating pins 42, 44 of the stud 30 and the engagement of these pins with the axially extending recesses such as grooves 48, 50 in the inner surface of the second receptacle 34, an axial adjustment of the stud 30 only occurs if the first receptacle 32 is swiveled via the grip 38. The rotational movement of the first receptacle 32 thereby is transformed into an axial adjustment of the stud 30. The rotational movement shifts the locating pins 42, 44 along the axial grooves 48, 50, in order to lock—or, respectively, release—the lower shell 16 to/from the inner container 10. A locking position is shown schematically in the upper image in FIG. 5, as is the unlocking position in the lower image of the same drawing.

Thus, the possibility is created of achieving an axial movement of the locking element 30, which is designed as a stud in the exemplary embodiment, by a rotational movement of the grip 38, without interrupting the edge surrounding the lower shell 16, which serves as a seal against splashing water. This is shown schematically in FIG. 1.

The operation of the twist prevention device—only rotational movement, low torque, no additional tools necessary—is very user-friendly. The inner container 10 can be loaded into and/or removed from the protective packaging, that is, into/out of the lower shell 16 of the outer container 12, in its storage position, without needing to be turned.

However, another advantage results from the inventive teaching. Namely, it is impossible to join the upper shell 14 to the lower shell 16 when the twist prevention device is unlocked, as will be explained by means of FIGS. 2 and 9.

The invention includes two support elements or supports 52, 54 extending from the lower shell 16, which are arranged on opposite sides of the twist prevention device and are connected with the bracket 36 in the exemplary embodiment. The surfaces of the supports 52, 54 are positioned in a plane, which extends parallel to the position of the grip 38 in its respective end position, as is shown schematically in the drawings.

The support 54 is associated with a counter element or counter support 56, which extends from the upper shell 14. When the lower shell 16 is joined to the upper shell 14, the distance between the support 54 and the counter support 56 is smaller than the effective extent of the handle between the lower and upper shells 14, 16, that is, the diameter of the grip 38 in the exemplary embodiment.

The counter support 56 is associated with the support 54, upon which the grip 38 rests when the stud 30 is not engaged with the apron 18 but instead is in its unlocked position. If one attempts to close the outer container 12 in this position, that is, to join the upper and lower shells 14, 16, the shells 14, 16 could not be properly joined, as the grip 38 would be located between the support 54 and the counter support 56.

In the locked position, that is, when the stud 30 engages with the apron 18, which results in the desired locking between inner container 10 and upper shell 16, the grip is located on the support 52, such that the lower and upper shell 14, 16 can be properly joined, as the support 54 and counter support 56 can be aligned sufficiently; this is due to the fact that the grip 38 is not located in the gap 58. Thus, the upper shell 14 can be set exactly on top of the lower shell 16 and the latches of lower and upper shell 14, 16 can be properly closed.

The inventive twist prevention device guarantees that protective elements of the inner container 10 that are positioned inside the outer container 12—that is, inside the protective packaging—can maintain their function under normal conditions and accident-related transport conditions, and that they will not be rendered ineffective by a rotation of the inner container 10 and that such a rotation cannot lead to components of the inner container 10 being damaged. The twist prevention device is designed such that a closing of the protective packaging—that is, of the outer container 12—is impossible insofar as the twist prevention device does not properly lock the inner and outer containers 10, 12. Therefore, any transport only is possible with a properly locked twist prevention device.

Regarding the dimensions and materials of the twist prevention device, the following must be noted.

The preferred material for the components is stainless steel.

The locking element 30—that is, the stud—may have a length of 60 to 95 mm and a diameter of 40 to 60 mm. The diameter of the first receptacle 32—that is, the first sleeve—is adjusted accordingly, which means that the diameter can be between 50 and 75 mm. The length should be between 60 and 95 mm, wherein a wall thickness between 4 and 10 mm is preferable.

The second receptacle, or sleeve 34, correspondingly should have a diameter of 65 to 90 mm and a length of 60 to 95 mm. The wall thickness may be between 4 and 8 mm.

Regarding the axially extending grooves 48, 50, it must be noted that their width should be between 5 and 10 mm and their depth between 2 and 5 mm.

The helical passage or opening 46, 47 should have a width of 5 to 15 mm.

The invention claimed is:

1. An arrangement for transporting uranium hexafluoride, comprising:

an inner container (10) having at least one apron (18, 20) projecting beyond an end face (22, 24) of the inner container, an outer container (12), which receives the inner container, and a twist prevention device, by means of which the containers can be locked together to prevent them from twisting about their longitudinal axes (15);

wherein the twist prevention device comprises:

a locking element (30) that is axially adjustable in a first receptacle (32) and in that receptacle's longitudinal direction, a second receptacle (34) that rotatably receives the first receptacle and is fixedly connected to one of the containers (10, 12), and a handle (38) that extends from the first receptacle and is radially guided by the second receptacle, the pivoting movement of said handle (38) being convertible via the first receptacle into the axial adjustment of the locking element for engagement in the other container (12, 10) or disengagement therefrom.

2. The arrangement according to claim 1, wherein the first receptacle (32) includes a hollow cylinder shape with at least one helical opening (46, 47) in axial direction, wherein said opening is penetrated by at least one protrusion (42, 44) extending from the locking element (30), and wherein the protrusion (42, 44) engages with a recess (48, 50) extending in the longitudinal direction of the second receptacle.

3. The arrangement according to claim 1, wherein the second receptacle (34) comprises a second opening (40) extending radially, and wherein the second opening is penetrated by the handle (38) extending from the first receptacle (32).

4. The arrangement according to claim 1, wherein the locking element (30) for preventing the twisting of the containers (10, 12) interacts with the apron (18) of the inner container (10).

5. The arrangement according to claim 1, wherein two helical first openings (46) are provided in the longitudinal direction of the first receptacle (32), and wherein protrusions (42, 44) extending from the locking element (30) engage with each of the first openings like an adjusting pin.

6. The arrangement according to claim 1, wherein the outer container (12) comprises two shells (14, 16) that are joined and can be locked when the inner container (10) is properly enclosed, wherein the handle (38) can be positioned in a locking position and in an unlocking position, wherein the shells (14, 16) of the outer container (12) are joined in the locking position of the handle, such that the outer container (12) properly surrounds the inner container (10), and wherein the shells are positioned at a distance from each other in the area of the handle when the same is in the unlocking position.

7. The arrangement according to claim 6, wherein two support elements (52, 54) for the handle (38) extend from one of the shells (16) of the outer container (12), wherein a counter element (56) associated with one of the support elements (54) extends from the other shell (14), and wherein the distance between the counter element and the associated support element is smaller than the effective extent of the handle between these two elements when the outer container is properly closed.

8. The arrangement according to claim 6, wherein the handle (38) extends along the support element (54), which is associated with the counter element (56), when the containers (10, 12) are unlocked.

* * * * *